United States Patent [19]

James

[11] Patent Number: 4,705,163

[45] Date of Patent: Nov. 10, 1987

[54] CAKE HOLDER

[76] Inventor: Tracye V. James, P.O. Box 8031, Temple Hills, Md. 20748

[21] Appl. No.: 10,478

[22] Filed: Feb. 3, 1987

[51] Int. Cl.[4] ..... B65D 85/36; B65D 25/00

[52] U.S. Cl. ..... 206/45.32; 312/284; 220/293; 220/300; 220/301

[58] Field of Search ..... 206/45.32; 220/293, 220/297, 298, 300, 301, 302, 315, 324, 326; D7/83, 84; 312/284

[56] References Cited

U.S. PATENT DOCUMENTS

| | | | |
|---|---|---|---|
| 2,113,041 | 4/1938 | Benson | 220/293 X |
| 3,511,288 | 5/1970 | Swett et al. | 206/45.2 X |
| 3,537,956 | 11/1970 | Falcone et al. | 220/293 X |
| 3,690,902 | 9/1972 | Dahl | 426/115 |
| 4,135,331 | 1/1979 | Lamlee | 220/301 X |
| 4,197,940 | 4/1980 | De Rossett | 312/284 X |
| 4,198,040 | 4/1980 | Colasent | 220/300 X |
| 4,333,580 | 6/1982 | Sweigart, Jr. | 220/300 X |
| 4,452,356 | 6/1984 | Dahl | 206/45.32 |

FOREIGN PATENT DOCUMENTS

| | | | |
|---|---|---|---|
| 60749 | 8/1913 | Austria | 220/293 |

*Primary Examiner*—Stephen Marcus
*Assistant Examiner*—Michael J. Shea
*Attorney, Agent, or Firm*—Kerkam, Stowell, Kondracki & Clarke

[57] ABSTRACT

A cake holder uses an advantageous arrangement whereby flanges from the cover may be secured into slots in the base. The cover and base are each integral pieces of plastic. Resilience of the flanges on the cover causes them to press against a surface of handles which project out from the base so as to prevent the cover from becoming accidentally separated from the base.

20 Claims, 6 Drawing Figures

CAKE HOLDER

BACKGROUND OF THE INVENTION

This invention relates to a cake holder and, more specifically, a disposable cake holder.

Various holders have heretofore been used for holding cakes. For example, U.S. Pat. No. 3,690,902 issued to Dahl on Sept. 12, 1972, discloses a cake package having a base and a hollow cake cover. The base is a piece of cardboard and the cover has flanges projecting out from an outer periphery of the cover such that the flanges may be stapled to the base.

Other cake holders have included a cake holder having a relatively thick plastic transluscent cover and a relatively thick plastic colored base. At the outer periphery of the base a pair of opposite handles extend radially outwardly. Each of the handles has an upper concave surface. The cover includes a pair of radially outwardly projecting flanges extending past the outer periphery of the cover to enable one to lift the cover off of the base. An upwardly projecting rim is disposed around a cake support surface of the base and mates to a corresponding circumferential groove on the underside of the cover.

Although various previous cake holders have been generally useful, they have often been subject to one or more of several disadvantages. For example, the cake holder may not include a convenient and reusable arrangement for attaching the cover to the base. Some prior cake holders are made of expensive material such that they may not be suitable for a bakery to use as a package to supply a cake to a customer.

OBJECTS AND SUMMARY OF THE INVENTION

Accordingly, it is a primary object of the present invention to provide a new and improved cake holder.

A more specific object of the present invention is to provide a cake holder which is relatively inexpensive to make such that it may be disposable and used for both commercial and home bakers.

A further object of the present invention is to provide a cake holder which has a convenient, reliable, and reusable arrangement for securing a cover to a base.

The above and other objects of the present invention which will become more apparent as the description proceeds are realized by a cake holder comprising a cover and a base, the base having: a circular central cake support surface for supporting a cake, a circumferential upwardly projecting rim disposed around the cake support surface, the base having a generally circular outer periphery with at least two handles projecting radially outwardly from the outer periphery, each handle having a slot therein; and the cover having: a top, an annular side wall extending downwardly from the top, a circumferential mating portion at the bottom of the side wall adapted for mating with the rim, the base having a generally circular outer periphery with at least two flanges projecting radially outwardly from the outer periphery of the base, each flange having an end portion extending out from a support portion in a circumferential direction to define an open space between the outer periphery of the cover and the end portion, each end portion removably securable to fit into a corresponding one of the slots. Preferably, both the cover and the base are plastic and the cake holder is disposable. Each of the handles may have an upper concave surface, or alternately, an upper convex surface. Each of the flanges has a tip which is lower than a point of attachment of the flange to the outer periphery of the cover. Both of the lock portions extend in the same clock sense direction (i.e., both are either clockwise or both are counter-clockwise) from their corresponding support portion. The cover is an integral plastic piece and the base is an integral plastic piece. Each flange is resilient and positioned such that it pushes upwardly on an underside of a corresponding one of the handles when it is within one of the slots. Each flange is positioned such that rotation of the cover relative to the base is sufficient to cause the flanges to fit into the slots. Each flange has a flange lock portion projecting in a first direction and lockable to a corresponding handle lock portion on a corresponding handle, the handle lock portion projecting in a second direction opposite to the first direction.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
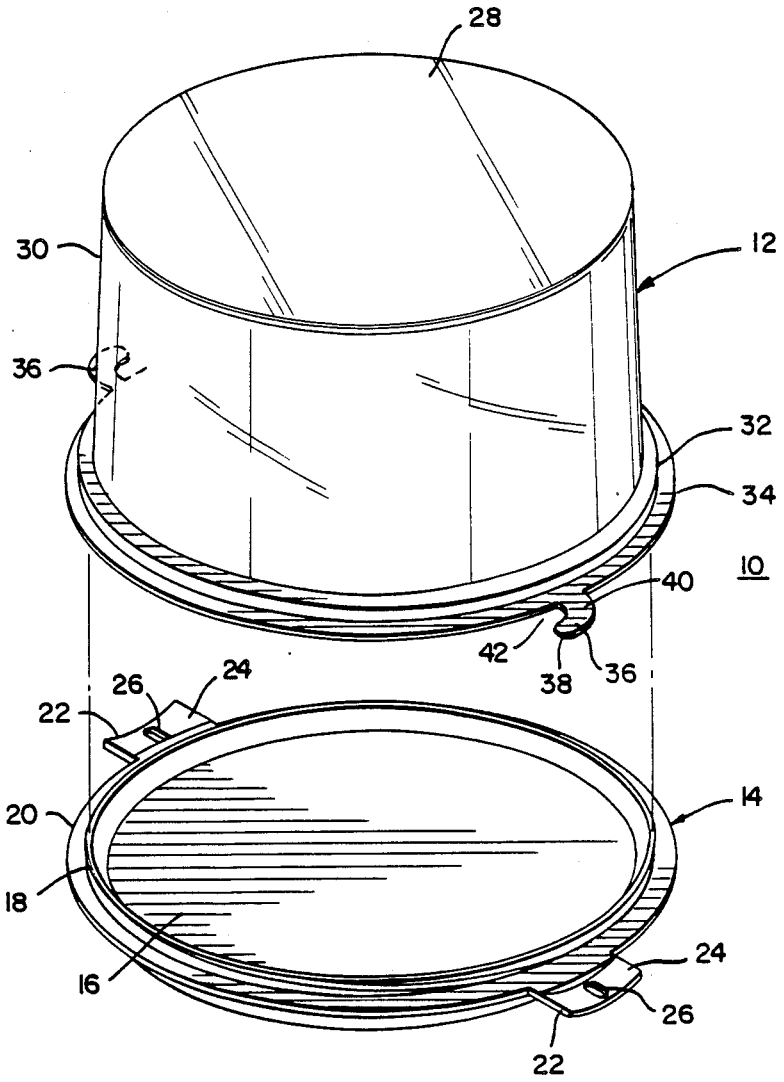
FIG. 1 shows a perspective view of the cake holder of the present invention with a cover separated from a base.
Figure 2:
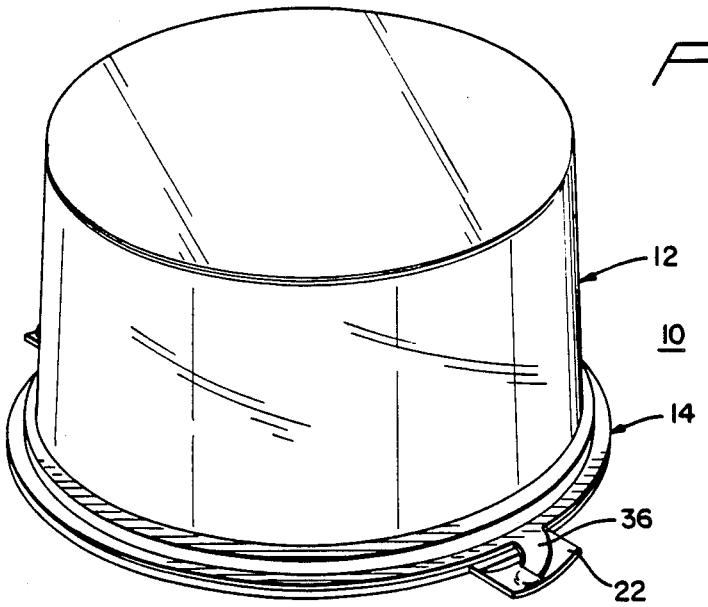
FIG. 2 shows a perspective view of the cake holder of FIG. 1 with the cover and base secured together.

The cake holder 10 of the present invention includes a cover 12 and a base 14 as shown in FIG. 1 and FIG. 2.

The base 14 includes a circular central cake support surface 16 which is surrounded by an upwardly projecting rim 18. Extending out from the generally circular outer periphery 20 of the base 14 are two handles 22 on opposite sides of the base 14. The handles 22 each have an upper concave surface 24 and a slot 26 which extends completely through the handle.

The cover 12 includes a top 28 and an annular side wall 30 extending down from the top and defining a chamber in which a cake may be disposed when the cover 12 is placed upon the base 14. At the bottom of the side wall 30 is a circumferential mating portion 32 which is adapted for mating with the rim 18. Extending out from the generally circular outer periphery 34 of the cover 12 are two flanges 36 disposed opposite each other and projecting radially outwardly from the outer periphery 34. Each flange 36 has an end portion 38 which extends out from a support portion 40 adjacent the outer periphery 34. As best seen in FIG. 1, the end portion 38 extends out from the support portion 40 in a circumferential direction to define an open space 42 between the outer periphery of the cover and the end portion 38.

Figure 3:
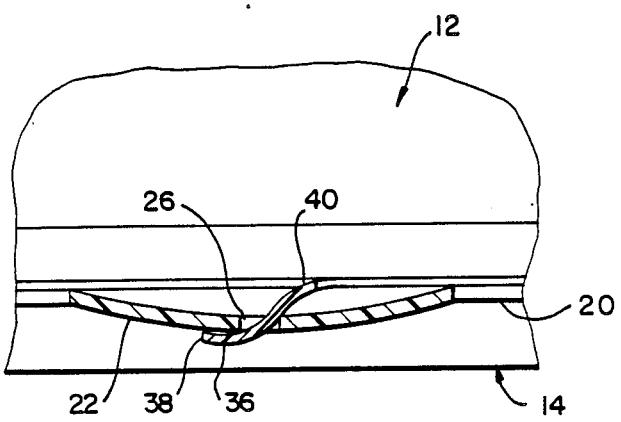
FIG. 3 shows a cross-section of a securing arrangement used with the present invention.
Figure 6:
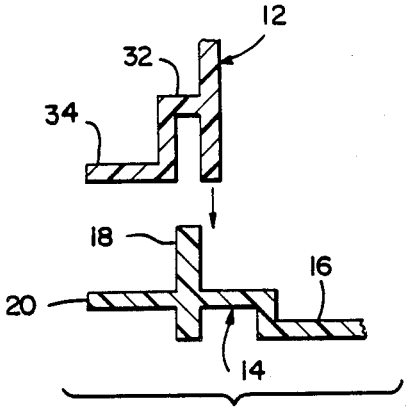
FIG. 6 shows a cross-section detailed view of a rim attachment arrangement used with the present invention.

With reference now also to the detail views of FIGS. 3 and 6, the cover 12 fits to the base 14 with the end portion 38 of flange 36 disposed in the slot 26 and with the rim 18 disposed within the mating portion 32 of the cover 12.

The cover 12 and base 14 are each an integral piece made of relatively thin plastic such that it is disposable. The plastic flanges 36 are resilient such that they will push slightly upwardly on the underside of the handle 22 when they are disposed in the position of FIG. 3. The tip at the end portion 38 may be slightly lower than the support portion 40 of the flange 36 if desirable to facilitate the positioning of flange 36 within slot 26. However, removal of the flange 36 from the slot 26 in FIG. 3 would cause the flange 36 to "spring" upwardly slightly to a relaxed position with the end portion 38 higher than its positioning in the view of FIG. 3.

Figure 4:
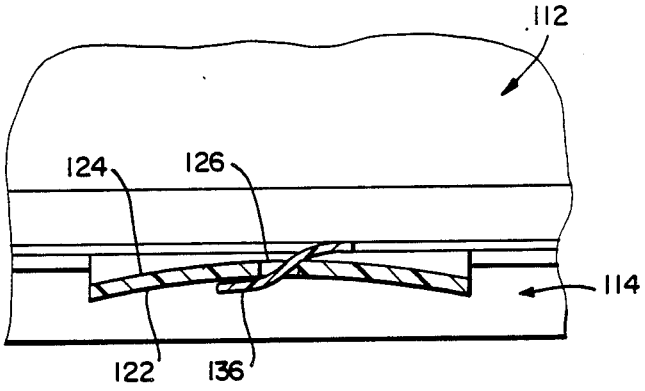
FIG. 4 shows a cross-section view of an alternate securing arrangement.

FIG. 4 shows an alternate arrangement whereby a cover 112 mates to a base 114 having a handle 122 with an upper convex surface 124 and a slot 126. Preferably, the arrangement of FIG. 4 has relative sizes of the slots 126 and the flange 136 such that rotation of the cover 112 relative to base 114 in the proper direction will result, without further steps, in each flange 136 (only one of two is shown) seating within a corresponding slot 126. Note that the shape of a pair of such flanges 136 would be identical in shape (as seen from above) as the flanges 36 of FIG. 1. Like the flanges 36, each of such flanges 136 would be oriented in the same clock sense direction. That is, they would either both extend counter-clockwise or both extend clockwise, this being necessary so that rotation of the cover relative to the base will cause them to both seat within the corresponding slot.

Figure 5:
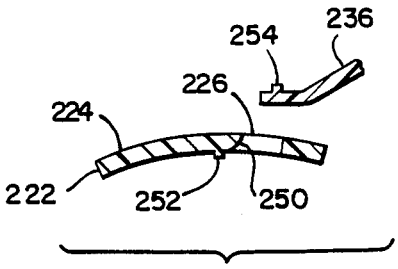
FIG. 5 shows a partial cross-section view of a third embodiment securing arrangement which may be used with the present invention.

FIG. 5 shows a simplified view of an alternative arrangement whereby a flange 236 will automatically seat within a slot 226 by rotation of a cover (not shown) relative to a base (not shown) in the same fashion as discussed with respect to FIG. 4. The slot 226 is disposed at one side of a handle 222 having a convex upper surface 224. The slot 226 includes a side edge 250 angled to allow easy entry of the flange 236. However, the base handle 222 includes a locking bead portion 252 projecting down and extending radially (relative to the center of the base) which locks to a locking bead portion 254 likewise extending radially, but projecting up. Each of the bead portions is simply a small strip of plastic material to provide locking of the base and cover together by virtue of the resilience of the flange 236. The flange 236 would have the same shape (as seen from above) illustrated for the flange 36 and has its tip (left end in FIG. 5) at a lower vertical position than the portion closer to the cover.

The operation of the invention is relatively straightforward. One may place a cake on surface 16 and push the cover 12 on top of the base 14 with the rim or thread 18 mating to the portion 32 of the cover. The cover is then simply twisted until the flanges 36 fit securely into the slots of the base.

Disassembly of the cake holder simply requires the cover to be twisted in the opposite direction from the original direction of locking. One simply twists the cover until the flanges 36, 136, or 236 (depending on the model) are freed from the slots. For the design of FIG. 5, the twisting force would be sufficient to free locking bead 252 from locking bead 254.

The cake holder may be made of pliable plastic in many different sizes. It can be reused, although it would preferably be made of sufficiently thin plastic as to be disposable such that a bakery may use the holder to supply its customers with cakes. The relatively low cost of the holder makes it possible for a bakery to use a holder instead of the commonly used cardboard boxes. The cake holder would also be useful for persons baking at home.

Although various specific constructions and materials have been described herein, it is to be understood that these are for illustrative purposes only. Various modifications and adaptations will be readily apparent to those of skill in the art. Accordingly, the scope of the present invention should be determined by reference to the claims appended hereto.

What is claimed is:

1. A cake holder comprising a cover and a base, said base having: a circular central cake support surface supporting a cake, a circumferential upwardly projecting rim disposed around said cake support surface, said base having a generally circular outer periphery with at least two handles projecting radially outwardly from said outer periphery, each handle having a slot therein; and said cover having: a top, an annular side wall extending downwardly from the top, a circumferential mating portion at the bottom of said side wall adapted for mating with said rim, said cover having a generally circular outer periphery with at least two flanges projecting radially outwardly from said the outer periphery of the cover, each flange having an end portion extending out from a support portion in a circumferential direction to define an open space between the outer periphery of the cover and the end portion, each end portion removably securable to fit into a corresponding one of said slots.

2. The cake holder of claim 1 wherein both the cover and the base are made of plastic.

3. The cake holder of claim 2 wherein the cake holder is disposable.

4. The cake holder of claim 1 wherein each of said handles has an upper concave surface.

5. The cake holder of claim 1 wherein said handles have an upper convex surface.

6. The cake holder of claim 1 wherein each of said flanges has a tip which is lower than a point of attachment of the flange to the outer periphery of the cover.

7. The cake holder of claim 1 wherein both of said end portions extend in the same clock sense direction from their corresponding support portion.

8. The cake holder of claim 7 wherein said cover is an integral plastic piece and said base is an integral plastic piece.

9. The cake holder of claim 1 wherein each flange is resilient and positioned such that it pushes upwardly on an underside of a corresponding one of said handles when it is within one of said slots.

10. The cake holder of claim 1 wherein each flange is positioned such that rotation of said cover relative to said base is sufficient to cause said flanges to fit into said slots.

11. The cake holder of claim 1 wherein each flange has a flange lock portion projecting in a first direction and lockable to a corresponding handle lock position on a corresponding handle, said handle lock portion projecting in a second direction opposite to said first direction.

12. A cake holder comprising a cover and a base, said base having: a circular central cake support surface for supporting a cake, a circumferential upwardly projecting rim disposed around said cake support surface, said base having a generally circular outer periphery with at least two handles projecting radially outwardly from said periphery, each handle having a slot therein; and said cover having: a top, an annular side wall extending downwardly from the top, a circumferential mating position at the bottom of said side wall adapted for mating with said rim, said cover having a generally circular outer periphery with at least two flanges projecting radially outwardly from said the outer periphery of the cover, and wherein each flange is removably securable to at least partially fit within a corresponding one of said slots and each flange is resilient and positioned such that it pushes upwardly on an underside of corresponding one of said handles when it is within one of said slots.

13. The cake holder of claim 12 wherein said cover is an integral plastic piece and said base is an integral plastic piece.

14. The cake holder of claim 13 wherein each of said flanges has a tip which is lower than a point of attachment of the flange to the outer periphery of the cover.

15. The cake holder of claim 12 wherein each flange is positioned such that rotation of said cover relative to said base is sufficient to cause said flanges to fit into said slots.

16. A cake holder comprising a cover and a base, said base having: a circular central cake support surface for supporting a cake, a circumferential upwardly projecting rim disposed around said cake support surface, said base having a generally circular outer periphery with at least two handles projecting radially outwardly from said periphery, each handle having a slot therein; and said cover having: a top, an annular side wall extending downwardly from the top, a circumferential mating portion at the bottom of said side wall adapted for mating with said rim, said cover having a generally circular outer periphery with at least two flanges projecting radially outwardly from said the outer periphery of the cover, and wherein each flange is removably securable to at least partially fit within a corresponding one of said slots and rotation of said cover relative to said base is sufficient to cause said flanges to fit into said slots.

17. The cake holder of claim 16 said cover is an integral plastic piece and said base is an integral plastic piece.

18. The cake holder of claim 17 wherein each flange has a flange lock portion projecting in a first direction and lockable to a corresponding handle lock portion on a corresponding handle, said handle lock portion projecting in a second direction opposite to said first direction.

19. The cake holder of claim 18 wherein each flange is resilient and positioned such that it pushes upwardly on an underside of a corresponding one of said handles when it is within one of said slots.

20. The cake holder of claim 17 wherein each of said flanges has a tip which is lower than a point of attachment of the flange to the outer periphery of the cover.

* * * * *